US011542623B2

(12) United States Patent
Tsuji et al.

(10) Patent No.: US 11,542,623 B2
(45) Date of Patent: Jan. 3, 2023

(54) PLATING APPARATUS, AIR BUBBLE REMOVING METHOD, AND STORAGE MEDIUM THAT STORES PROGRAM TO CAUSE COMPUTER IN PLATING APPARATUS TO EXECUTE AIR BUBBLE REMOVING METHOD

(71) Applicant: EBARA CORPORATION, Tokyo (JP)

(72) Inventors: Kazuhito Tsuji, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/462,957

(22) Filed: Aug. 31, 2021

(65) Prior Publication Data

US 2022/0106698 A1 Apr. 7, 2022

(30) Foreign Application Priority Data

Oct. 1, 2020 (JP) ..... JP2020-166988

(51) Int. Cl.

| | |
|---|---|
| ***C25D 17/02*** | (2006.01) |
| ***C25D 17/06*** | (2006.01) |
| ***C25D 21/04*** | (2006.01) |
| ***C25D 7/12*** | (2006.01) |
| ***C25D 17/00*** | (2006.01) |

(52) U.S. Cl.

CPC ..... *C25D 17/001* (2013.01); *C25D 17/002* (2013.01); *C25D 17/02* (2013.01); *C25D 17/06* (2013.01); *C25D 21/04* (2013.01); *C25D 7/123* (2013.01)

(58) Field of Classification Search

CPC ..... C25D 21/04; C25D 7/12–123; C25D 17/001; C25D 17/002; H01L 21/2885; H01L 21/76873

See application file for complete search history.

(56) References Cited

U.S. PATENT DOCUMENTS

| | | | | |
|---|---|---|---|---|
| 5,516,417 A * | 5/1996 | Kondou | ..... | C25D 15/02 205/148 |
| 10,954,602 B1 * | 3/2021 | Zhang | ..... | C25D 17/001 |
| 2003/0070932 A1 * | 4/2003 | Sakaki | ..... | C25D 21/04 204/199 |

(Continued)

FOREIGN PATENT DOCUMENTS

| | | | | |
|---|---|---|---|---|
| CN | 107022776 A * | 8/2017 | ..... | C25D 17/00 |
| JP | 2008-019496 A | 1/2008 | | |

*Primary Examiner* — Ho-Sung Chung

(74) *Attorney, Agent, or Firm* — BakerHostetler

(57) ABSTRACT

A plating module includes a plating tank, a substrate holder, an elevating mechanism, an anode, an ionically resistive element, a supply pipe, and a bypass pipe. The substrate holder is for holding a substrate Wf with a surface to be plated Wf-a facing downward. The elevating mechanism is for moving up and down the substrate holder. The anode is disposed inside the plating tank so as to face the substrate Wf held by the substrate holder. The ionically resistive element is disposed between the anode and the substrate Wf. The supply pipe is for supplying a process liquid stored in a reservoir tank from a lower side of the ionically resistive element to the plating tank. The bypass pipe is for discharging the process liquid supplied to the plating tank via the supply pipe from the lower side of the ionically resistive element to the reservoir tank.

12 Claims, 10 Drawing Sheets

(56) References Cited

U.S. PATENT DOCUMENTS

| | | | | |
|---|---|---|---|---|
| 2012/0064462 | A1* | 3/2012 | Willey | C25D 21/12<br>204/229.4 |
| 2014/0166476 | A1* | 6/2014 | Abraham | C25D 5/08<br>204/237 |
| 2018/0237933 | A1* | 8/2018 | Mayer | C25D 3/60 |

* cited by examiner

1000

PLATING APPARATUS, AIR BUBBLE REMOVING METHOD, AND STORAGE MEDIUM THAT STORES PROGRAM TO CAUSE COMPUTER IN PLATING APPARATUS TO EXECUTE AIR BUBBLE REMOVING METHOD

TECHNICAL FIELD

This application relates to a plating apparatus, an air bubble removing method, and a storage medium that stores a program to cause a computer in the plating apparatus to execute the air bubble removing method. This application claims priority from Japanese Patent Application No. 2020-166988 filed on Oct. 1, 2020. The entire disclosure including the descriptions, the claims, the drawings, and the abstracts in Japanese Patent Application No. 2020-166988 is herein incorporated by reference.

BACKGROUND ART

There has been known a cup type electroplating apparatus as one example of a plating apparatus. The cup type electroplating apparatus immerses a substrate (for example, a semiconductor wafer) held by a substrate holder in a plating solution with a surface to be plated facing downward, and applies a voltage between the substrate and an anode to deposit a conductive film on a surface of the substrate.

For example, as disclosed in PTL 1, a cup type electroplating apparatus that supplies a plating tank with a plating solution, stores the plating solution overflowed from an upper edge of the plating tank in a tank, and circulates the plating solution stored in the tank in the plating tank has been known.

CITATION LIST

Patent Literature

PTL 1: Japanese Unexamined Patent Application Publication No. 2008-19496

SUMMARY OF INVENTION

Technical Problem

However, in the electroplating apparatus of the related art, it is not considered that air bubbles remain on a back surface of an ionically resistive element when the liquid is put into the plating tank.

That is, there may be a case where the cup type electroplating apparatus includes the ionically resistive element disposed between the anode and the substrate to supply a uniform electric field to the surface to be plated of the substrate. The ionically resistive element can be configured of a porous plate-shaped member or a plate-shaped member in which a plurality of through-holes to communicate between the anode side and the substrate side are formed.

Here, when a process liquid, such as a plating solution, is poured into the empty plating tank, air bubbles possibly mix in the plating tank due to entraining of air in a supply pipe for the process liquid or the like. When the liquid is continuously poured as it is and the plating tank is filled with the process liquid, small air bubbles pass through the porous holes or the through-holes in the ionically resistive element and move up to exit from a liquid surface of the process liquid. However, air bubbles larger than the porous holes or the through-holes in the ionically resistive element possibly remain on the back surface of the ionically resistive element. The air bubbles remaining on the back surface of the ionically resistive element possibly affect a plating performance and therefore are not preferred.

Therefore, one object of this application is to reduce air bubbles remaining on a back surface of an ionically resistive element when a liquid is poured into a plating tank.

Solution to Problem

According to one embodiment, there is disclosed a plating apparatus that includes a plating tank, a substrate holder, an elevating mechanism, an anode, an ionically resistive element, a supply pipe, and a bypass pipe. The substrate holder is for holding a substrate with a surface to be plated facing downward. The elevating mechanism is for moving up and down the substrate holder. The anode is disposed inside the plating tank so as to face the substrate held by the substrate holder. The ionically resistive element is disposed between the anode and the substrate. The supply pipe is for supplying a process liquid stored in a reservoir tank from a lower side of the ionically resistive element to the plating tank. The bypass pipe is for discharging the process liquid supplied to the plating tank via the supply pipe from the lower side of the ionically resistive element to the reservoir tank.

DESCRIPTION OF EMBODIMENTS

Figure 1:
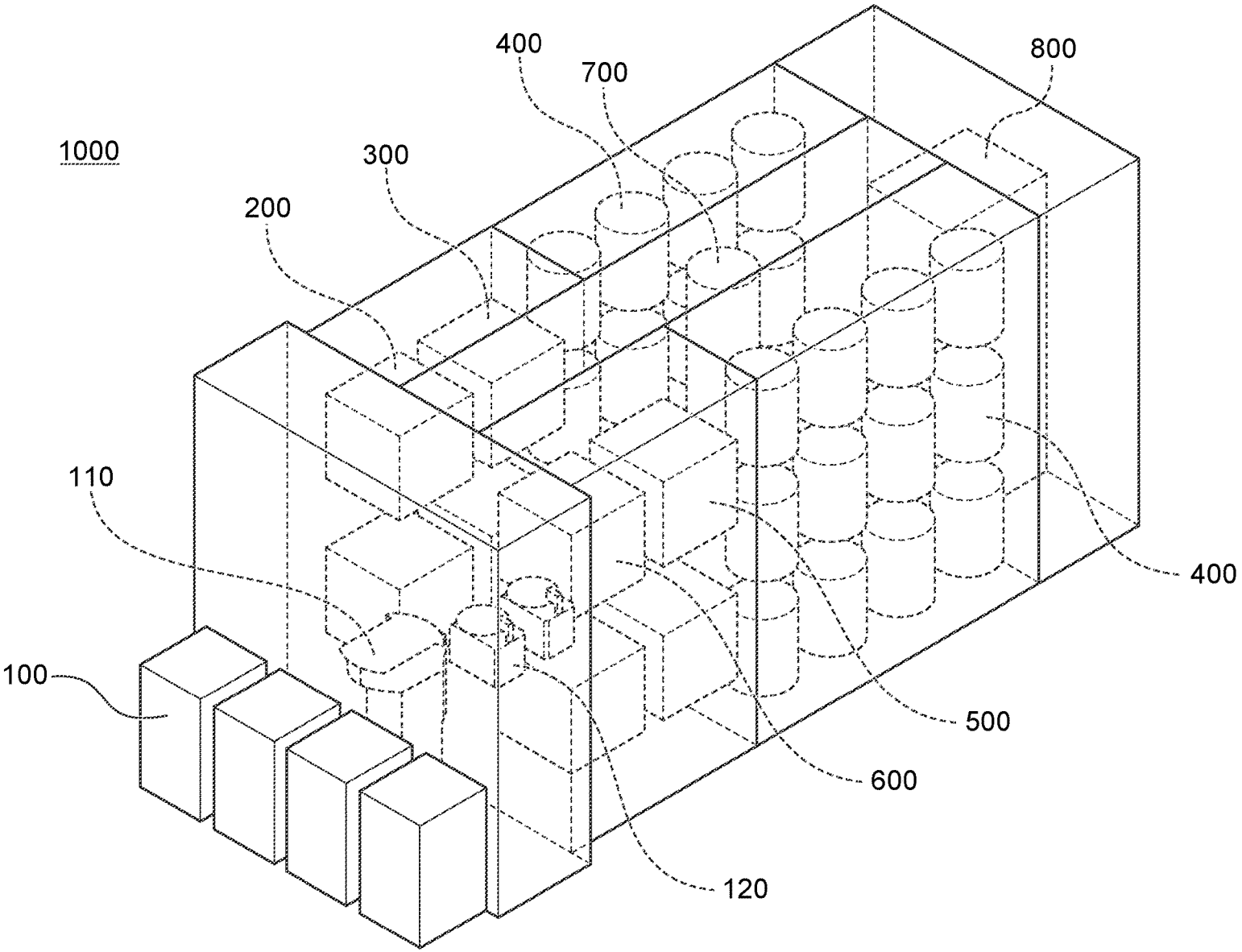
FIG. 1 is a perspective view illustrating an overall configuration of a plating apparatus of this embodiment.

The following will describe an embodiment of the present invention with reference to the drawings. In the drawings described later, the identical reference numerals are assigned for the identical or equivalent constituent elements, and therefore such elements will not be further elaborated here.

<Overall Configuration of Plating Apparatus>

FIG. 1 is a perspective view illustrating the overall configuration of the plating apparatus of this embodiment.

Figure 2:
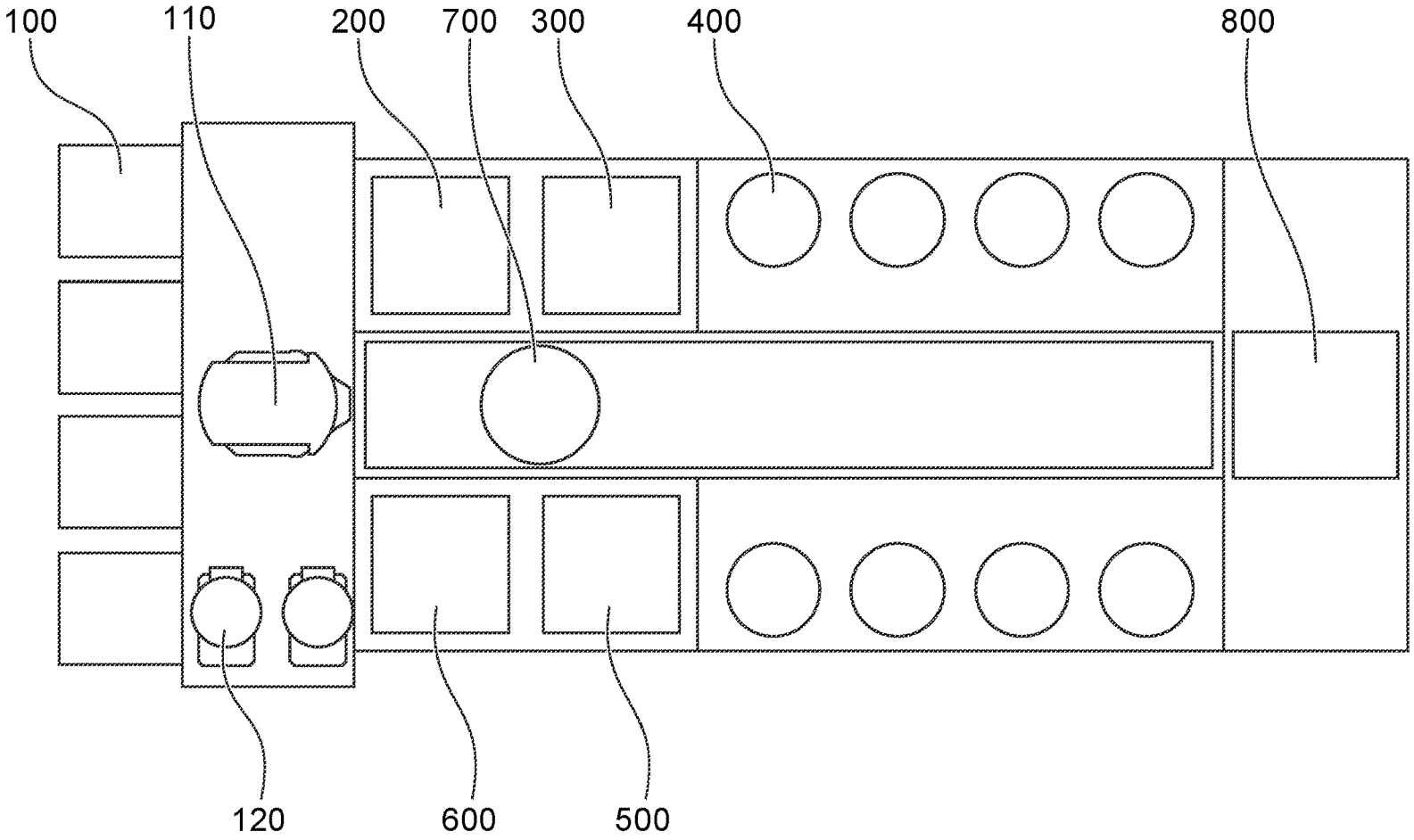
FIG. 2 is a plan view illustrating the overall configuration of the plating apparatus of this embodiment.

FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 70) can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 70) transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Figure 3:
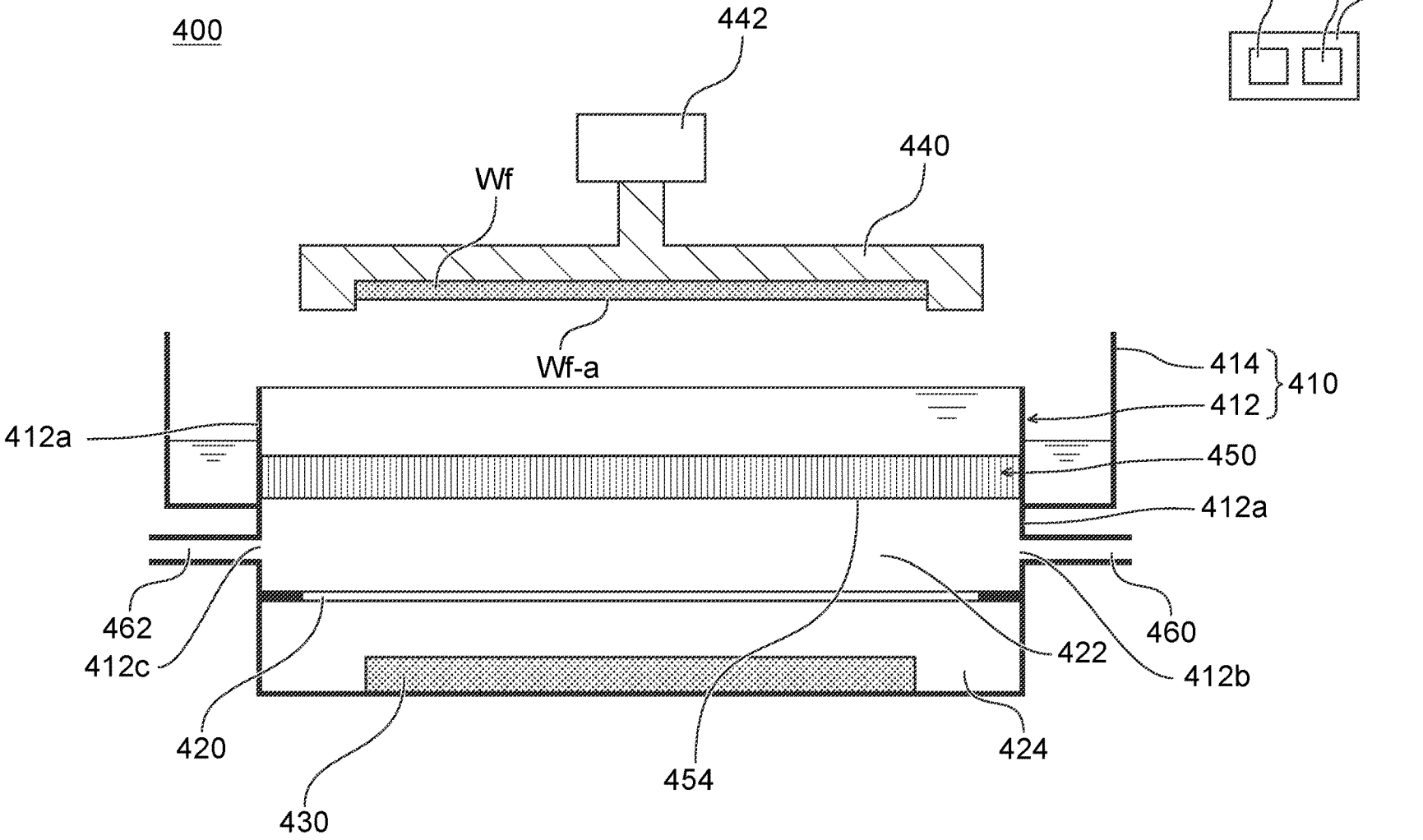
FIG. 3 is a vertical cross-sectional view schematically illustrating a configuration of a plating module of a first embodiment.

Next, the configuration of the plating module 400 will be described. Since the 24 plating modules 400 according to the embodiment have the identical configuration, only one plating module 400 will be described. FIG. 3 is a vertical cross-sectional view schematically illustrating the configuration of the plating module 400 of the first embodiment. As illustrated in FIG. 3, the plating module 400 includes a plating tank 410 to house the plating solution. The plating tank 410 includes an inner tank 412 and an outer tank 414. The inner tank 412 has a cylindrical shape with an open top surface. The outer tank 414 is disposed at the peripheral area of the inner tank 412 so as to store the plating solution overflew from an upper edge of the inner tank 412.

The plating module 400 includes a membrane 420 that separates the inside of the inner tank 412 in the vertical direction. The inside of the inner tank 412 is partitioned into a cathode region 422 and an anode region 424 by the membrane 420. The respective cathode region 422 and anode region 424 are loaded with the plating solutions. An anode 430 is disposed on the bottom surface of the inner tank 412 in the anode region 424. An ionically resistive element 450 facing the membrane 420 is disposed in the cathode region 422. The ionically resistive element 450 is a member to uniformize the plating process on a surface to be plated Wf-a of a substrate Wf. While the example of disposing the membrane 420 has been described in this embodiment, the membrane 420 may be omitted.

The plating module 400 includes a substrate holder 440 to hold a substrate Wf with the surface to be plated Wf-a facing downward. The substrate holder 440 includes a power feeding contact point (not illustrated) to feed power from a power source to the substrate Wf. The plating module 400 includes an elevating mechanism 442 to move up and down the substrate holder 440. The elevating mechanism 442 can be achieved by the known mechanism, such as a motor. The plating module 400 immerses the substrate Wf in the plating solution in the cathode region 422 using the elevating mechanism 442, and applies a voltage between the anode 430 and the substrate Wf to perform the plating process on the surface to be plated Wf-a of the substrate Wf.

When the plating solution is poured into the empty plating tank 410, for example, at start-up of the plating module 400, the plating module 400 of this embodiment is configured to supply the plating solutions to the respective cathode region 422 and anode region 424. To the anode region 424, the plating solution is supplied from a supply pipe (not illustrated) connected to the anode region 424. Meanwhile, as illustrated in FIG. 3, to supply the cathode region 422 with the plating solution, a supply port 412*b* is formed on the lower side of the ionically resistive element 450 and on the upper side of the membrane 420 in a sidewall 412*a* of the inner tank 412. The plating module 400 includes a supply pipe 460 connected to the supply port 412*b* to supply the plating solution to the cathode region 422 inside the inner tank 412.

Figure 4:
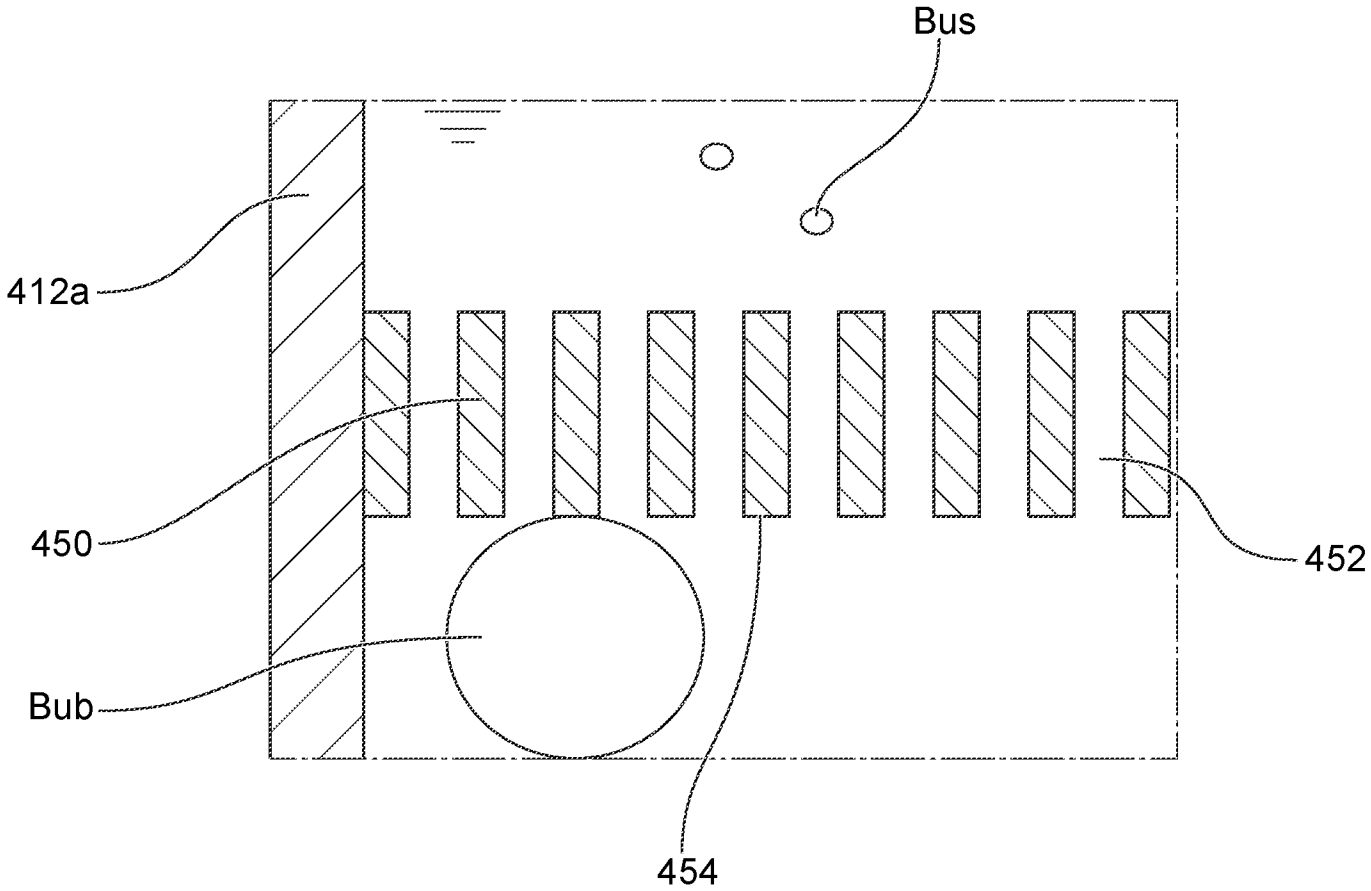
FIG. 4 is a drawing schematically illustrating an air bubble remaining on a back surface of an ionically resistive element.

Here, when the liquid is poured into the cathode region 422, there may be a case where air bubbles mix in the inner tank 412 (the cathode region 422) due to, for example, entraining of air in the plating solution in the supply pipe 460. FIG. 4 is a drawing schematically illustrating an air bubble remaining on the back surface of the ionically resistive element 450. As illustrated in FIG. 4, the ionically resistive element 450 is configured of a plate-shaped member in which a plurality of through-holes 452 extending in the vertical direction are formed so as to communicate between the side where the anode 430 is installed and the side where the substrate Wf is immersed. When the supply of the plating solution entraining air is continued and the inner tank 412 is filled with the plating solution, as illustrated in FIG. 4, although small air bubbles Bus pass through the through-holes 452 in the ionically resistive element 450 and move up to exit from a plating solution surface, an air bubble Bub larger than the through-hole 452 in the ionically resistive element 450 possibly remains on a back surface 454 of the ionically resistive element 450. The air bubbles Bub remaining on the back surface 454 of the ionically resistive element 450 possibly affect a plating performance and therefore are not preferred. Note that the ionically resistive element 450 is not limited to the configuration of this embodiment, but, for example, can be configured of a porous plate-shaped member.

In contrast to this, as illustrated in FIG. 3, the plating module 400 of the first embodiment includes a discharge port 412*c* at a position facing the supply port 412*b* in the sidewall 412*a* of the inner tank 412. The plating module 400 includes a bypass pipe 462 connected to the discharge port 412*c* to discharge the plating solution supplied to the plating tank 410 (the inner tank 412) via the supply pipe 460. The following will describe circulation of the plating solution using the bypass pipe 462.

Figure 5:
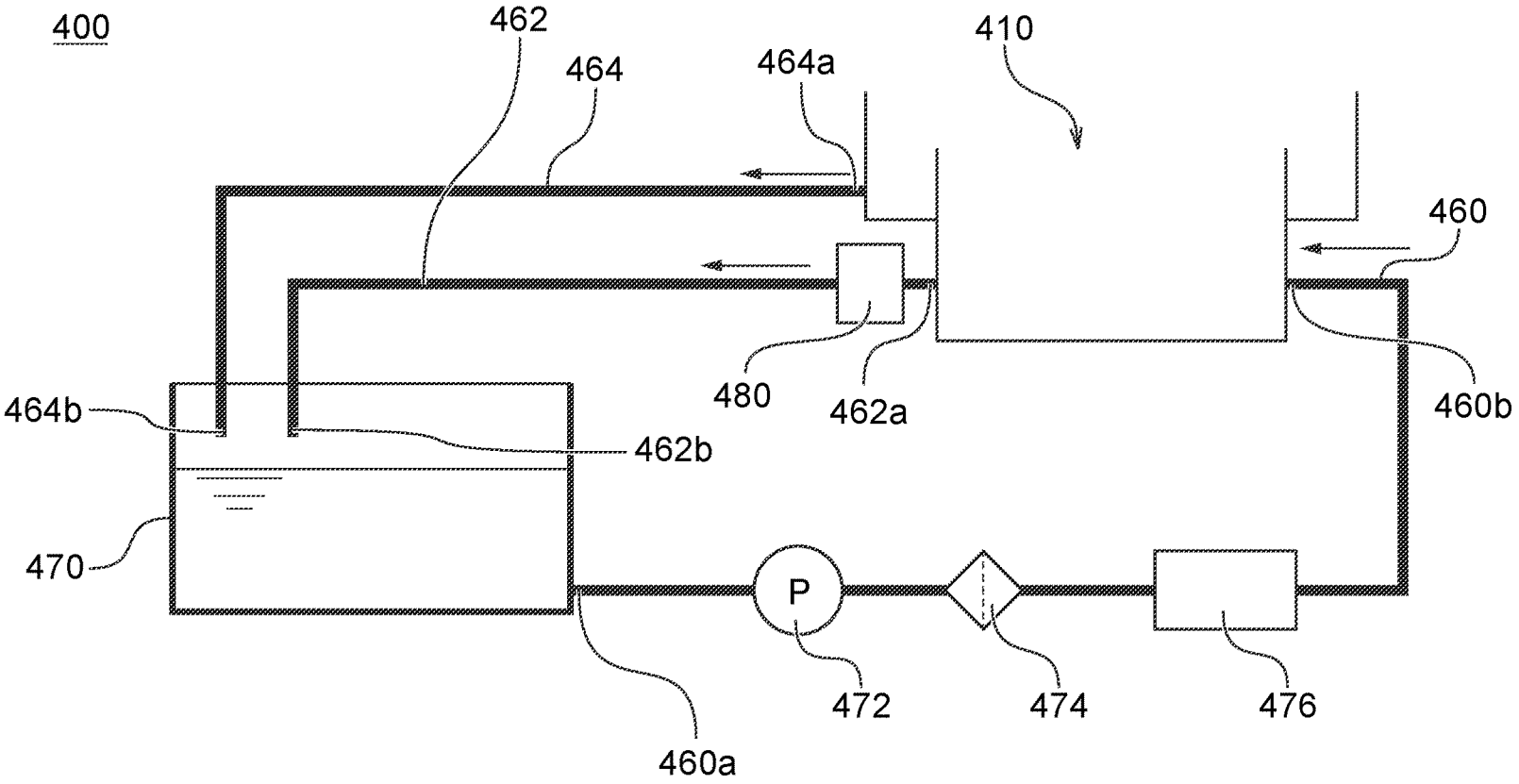
FIG. 5 is a drawing schematically illustrating a circulation passage for a process liquid in the plating module of the first embodiment.

FIG. 5 is a drawing schematically illustrating a circulation passage for the process liquid in the plating module 400 of the first embodiment. As illustrated in FIG. 5, the plating module 400 includes a reservoir tank 470 configured to store the plating solution. The supply pipe 460 has a first end portion 460*a* connected to the reservoir tank 470 and a second end portion 460*b* connected to the supply port 412*b* of the inner tank 412. The supply pipe 460 includes a pump 472 for discharging the plating solution stored in the reservoir tank 470 to the inner tank 412. The supply pipe 460 includes a filter 474 for removing a foreign matter, such as dust, contained in the plating solution and a thermostat 476 to keep the plating solution at a predetermined temperature.

Meanwhile, the bypass pipe 462 has a first end portion 462*a* connected to the discharge port 412*c* of the inner tank 412 and a second end portion 462*b* connected to the reservoir tank 470. The bypass pipe 462 includes a flow rate adjustment mechanism 480 configured to adjust a flow rate of the plating solution flowing through the bypass pipe 462. The flow rate adjustment mechanism 480, for example, may be an open/close valve that allows opening and closing the bypass pipe 462 or may be a throttle valve that allows performing variable control on the flow rate of the plating solution flowing through the bypass pipe 462. When the plating solution is flowed through the bypass pipe 462 with the flow rate adjustment mechanism 480, the plating solution supplied to the inner tank 412 via the supply pipe 460 is discharged to the reservoir tank 470 via the bypass pipe 462. The plating solution inside the reservoir tank 470 containing the plating solution discharged via the bypass pipe 462 is supplied to the inner tank 412 via the supply pipe 460 with the pump 472. Consequently, the plating solution circulates between the inner tank 412 and the reservoir tank 470. Note that the plating module 400 includes a return pipe 464 to return the plating solution stored in the outer tank 414 to the reservoir tank 470. The return pipe 464 has a first end portion 464*a* connected to the outer tank 414 and a second end portion 464*b* connected to the reservoir tank 470.

When the liquid is poured, the plating module 400 circulates the plating solution between the inner tank 412 and the reservoir tank 470 while adjusting a discharge amount of the pump 472 such that the liquid surface of the plating solution inside the inner tank 412 does not become higher than the back surface 454 of the ionically resistive element 450. While the plating solution circulates between the inner tank 412 and the reservoir tank 470, the air bubbles contained in the plating solution exit, for example, from the liquid surface of the plating solution inside the inner tank 412 or the liquid surface of the plating solution inside the reservoir tank 470 to atmosphere.

The plating module 400 circulates the plating solution, for example, for a predetermined period experimentally obtained through experiment or the like to ensure removing air bubbles contained in the plating solution. The plating module 400 removes the air bubbles in the plating solution by circulating the plating solution and after that closes the bypass pipe 462 using the flow rate adjustment mechanism 480 to stop the circulation of the plating solution. On the other hand, the plating module 400 continues supplying the plating solution not containing air bubbles to the inner tank 412 with the pump 472 to fill the inner tank 412 with the plating solution up to the upper side of the ionically resistive element 450, and after that can perform the plating process of the substrate Wf. As described above, according to this embodiment, when the liquid is poured into the plating tank 410 (the inner tank 412), the air bubbles Bub remaining on the back surface 454 of the ionically resistive element 450 can be reduced. For example, as illustrated in FIG. 3, the various components constituting the plating module 400, such as the elevating mechanism 442, the pump 472, and the flow rate adjustment mechanism 480, can be controlled by the control module 800 including a processing device 810 (for example, a CPU) and a storage medium 820. However, the aspect is not limited to the above-described one, after removing the air bubbles in the plating solution by circulating the plating solution, the plating module 400 may reduce the flow rate of the plating solution flowing through the bypass pipe 462 using the flow rate adjustment mechanism 480 to continue flowing a small amount of the plating solution from the bypass pipe 462. In this case, the plating module 400 can reduce the flow rate of the plating solution flowing through the bypass pipe 462 such that the supply amount of the plating solution to the inner tank 412 becomes more than the discharge amount of the plating solution from the bypass pipe 462 to ensure loading (filling) the inner tank 412 with the plating solution.

Note that the example in which the discharge port 412*c* is formed at the position facing the supply port 412*b* has been described in this embodiment, the configuration is not limited to this. The discharge port 412*c* only needs to be formed on the lower side of the ionically resistive element 450 and on the upper side of the membrane 420 in the sidewall 412*a* of the inner tank 412. In a case where the plating module 400 does not include the membrane 420, the discharge port 412*c* only needs to be formed on the lower side of the ionically resistive element 450 in the sidewall 412*a* of the inner tank 412. As one example, the discharge port 412*c* may be formed in the sidewall 412*a* of the inner tank 412 so as to be positioned on the upper side of the supply port 412*b*. Since the air bubbles contained in the plating solution supplied to the inner tank 412 are present in the upper portion of the plating solution, disposing the discharge port 412*c* at the position higher than the supply port 412*b* easily discharging the air bubbles from the discharge port 412*c*. While the plating solution has been described as one example of the process liquid poured into the plating tank 410 in this embodiment, the process liquid is not limited to the plating solution, and may be a cleaning liquid to clean the plating tank 410. The cleaning liquid may be, for example, pure water, and may be an alkaline aqueous solution (for example, sodium hydroxide and potassium hydroxide) and a Sulfuric Acid Hydrogen Peroxide Mixture (SPM) solution for organic matter contamination, such as diluted sulfuric acid, citric acid, and an additive component, and may be a water solution, such as nitric acid for metal contamination.

Figure 6:
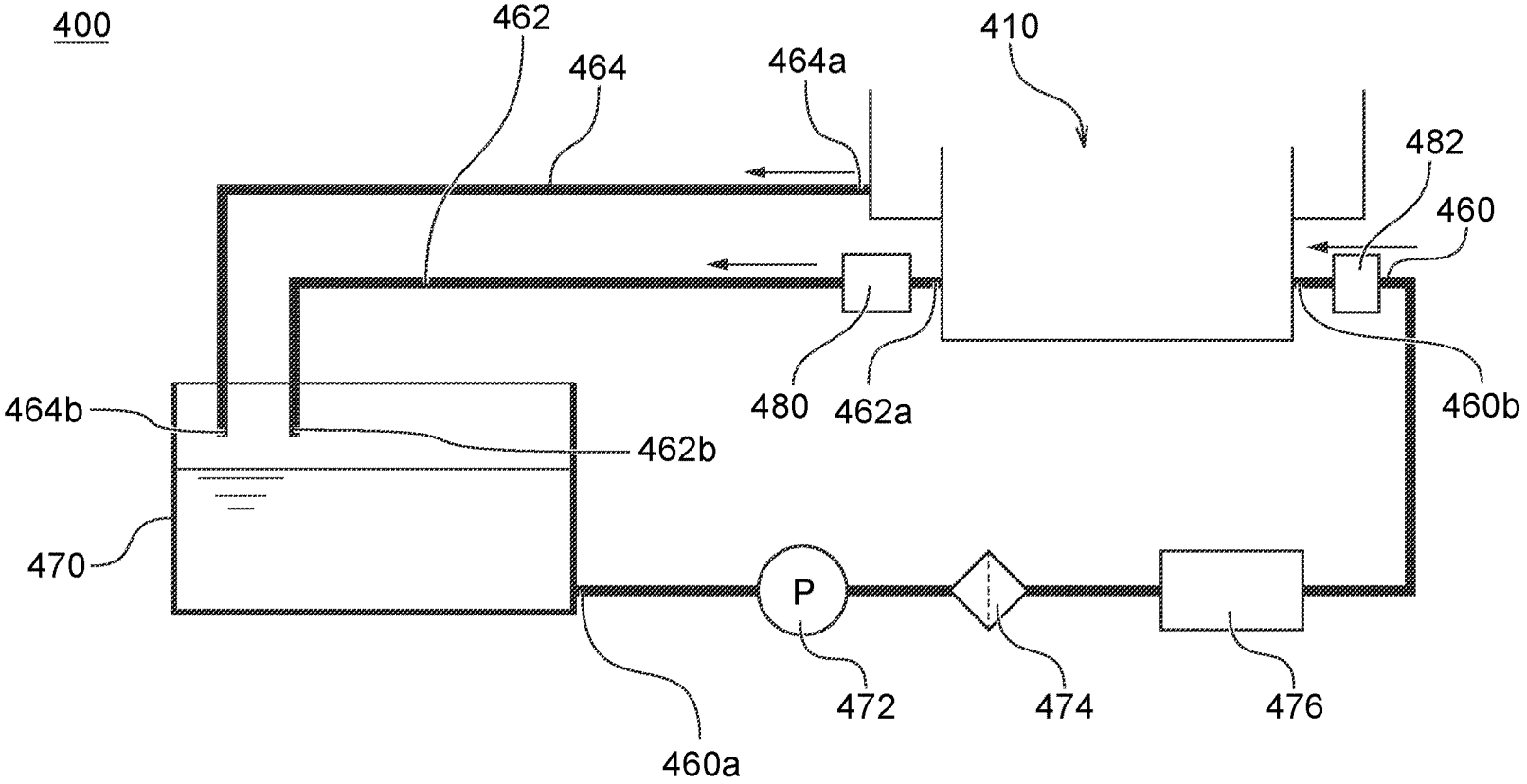
FIG. 6 is a drawing schematically illustrating a circulation passage for a process liquid in a plating module of a second embodiment.

FIG. 6 is a drawing schematically illustrating a circulation passage for a process liquid in a plating module of a second embodiment. Since the plating module of the second embodiment has a configuration similar to that of the first embodiment except for including a pipe air bubble detection sensor 482, the description of the configuration overlapping with the first embodiment will be omitted.

As illustrated in FIG. 6, the plating module 400 of the second embodiment includes the pipe air bubble detection sensor 482 configured to detect a presence of air bubbles in the plating solution flowing through the supply pipe 460. For example, the pipe air bubble detection sensor 482 may be an ultrasonic wave sensor that can transmit an ultrasonic wave to the plating solution flowing through the supply pipe 460, receive the ultrasonic wave propagating the plating solution, and detect the presence of air bubbles based on a strength of the received ultrasonic wave, but is not limited to the ultrasonic wave sensor. Similarly to first embodiment, the plating module 400 of the second embodiment can determine whether the air bubbles contained in the plating solution are removed by the pipe air bubble detection sensor 482 while circulating the plating solution.

In the plating module 400 of the second embodiment, the flow rate adjustment mechanism 480 can adjust the flow rate of the plating solution flowing through the bypass pipe 462 according to the detection result by the pipe air bubble detection sensor 482. Specifically, when the pipe air bubble detection sensor 482 does not detect the presence of air bubbles in the plating solution for a predetermined period, the flow rate adjustment mechanism 480 can close the bypass pipe 462 to stop the circulation of the plating solution. According to this embodiment, whether the air bubbles are present in the plating solution can be confirmed using the pipe air bubble detection sensor 482, and therefore after the air bubbles are not contained in the plating solution, the circulation of the plating solution can be stopped and the plating solution can be stored in the inner tank 412. As a result, according to this embodiment, the air bubbles Bub remaining on the back surface 454 of the ionically resistive element 450 when the liquid is poured into the inner tank 412 can be reduced with more certainty. Note that while the example in which the pipe air bubble detection sensor 482 is disposed in the supply pipe 460 has been described in this embodiment, the pipe air bubble detection sensor 482 may be disposed in the bypass pipe 462 to ensure detecting the presence of air bubbles in the plating solution flowing through the bypass pipe 462.

Figure 7:
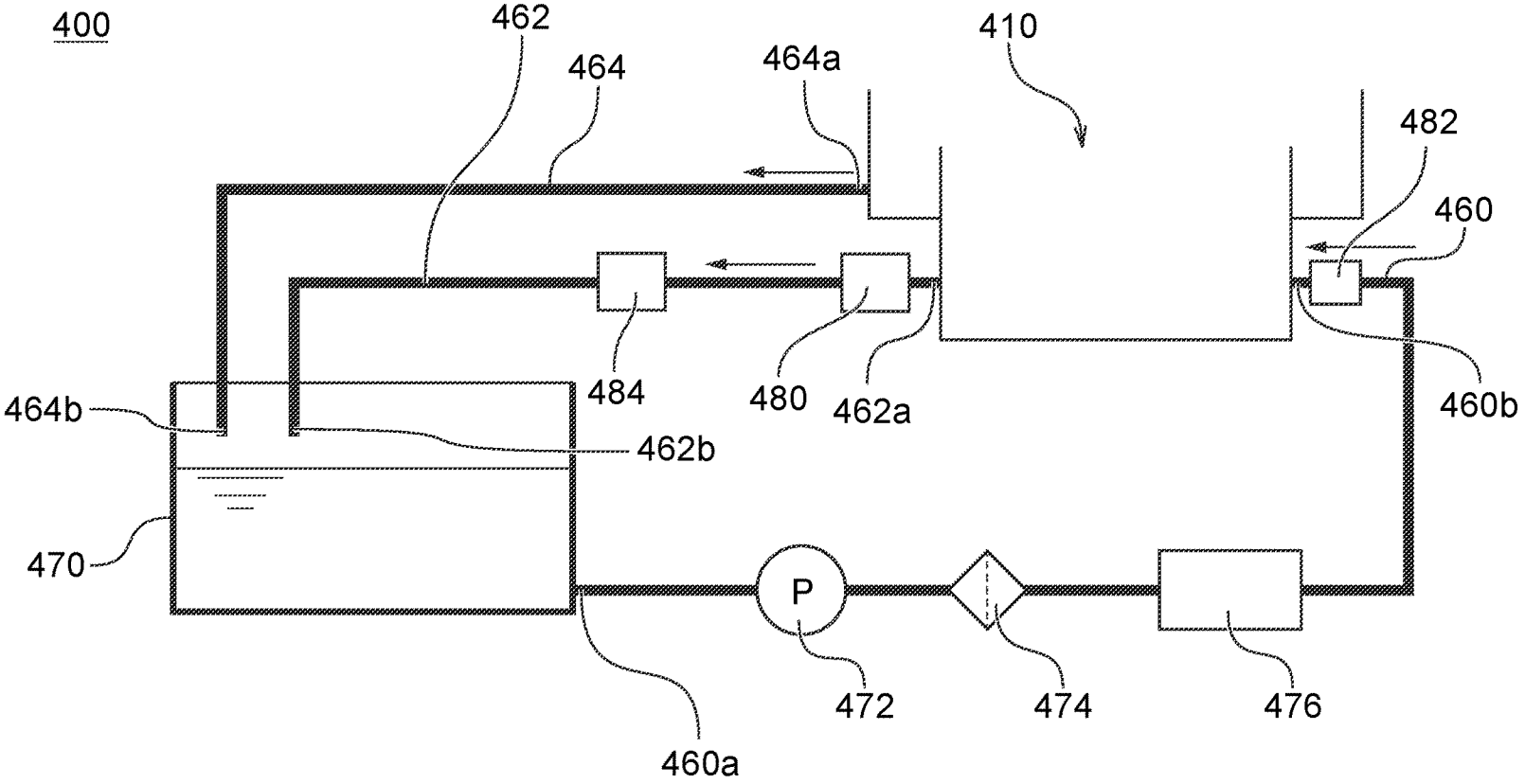
FIG. 7 is a drawing schematically illustrating a circulation passage for a process liquid in a plating module of a third embodiment.

FIG. 7 is a drawing schematically illustrating a circulation passage for a process liquid in a plating module of a third embodiment. Since the plating module of the third embodiment has a configuration similar to that of the second embodiment except for including a degassing module 484, the description of the configuration overlapping with the second embodiment will be omitted.

As illustrated in FIG. 7, the plating module 400 includes the degassing module 484 configured to remove the air bubbles contained in the plating solution flowing through the bypass pipe 462. In this embodiment, the degassing module 484 removes the air bubbles contained in the plating solution while the plating solution circulates between the inner tank 412 and the reservoir tank 470. In this embodiment, while the example in which the degassing module 484 is disposed in the bypass pipe 462 has been described, the configuration is not limited to this, and the degassing module 484 may be disposed in the supply pipe 460.

According to this embodiment, the use of the degassing module 484 allows efficiently removing the air bubbles in the plating solution, and therefore, the air bubbles Bub remaining on the back surface 454 of the ionically resistive element 450 when the liquid is poured into the inner tank 412 can be reduced with more certainty. Additionally, since the use of the degassing module 484 allows efficiently removing the air bubbles in the plating solution, the circulation period of the plating solution to remove the air bubbles can be shortened. Consequently, the liquid can be promptly poured into the plating tank 410 at the start-up of the plating module 400 or the like. While the embodiments from FIG. 5 to FIG. 7 have described the example of one reservoir tank 470 being connected to one plating tank 410, the configuration is not limited to this. The plurality of (for example, two) plating tanks 410 having a similar pipe structure may be connected to one reservoir tank 470. That is, the plurality of plating tanks 410 having the similar pipe structure may share one reservoir tank 470.

Figure 8:
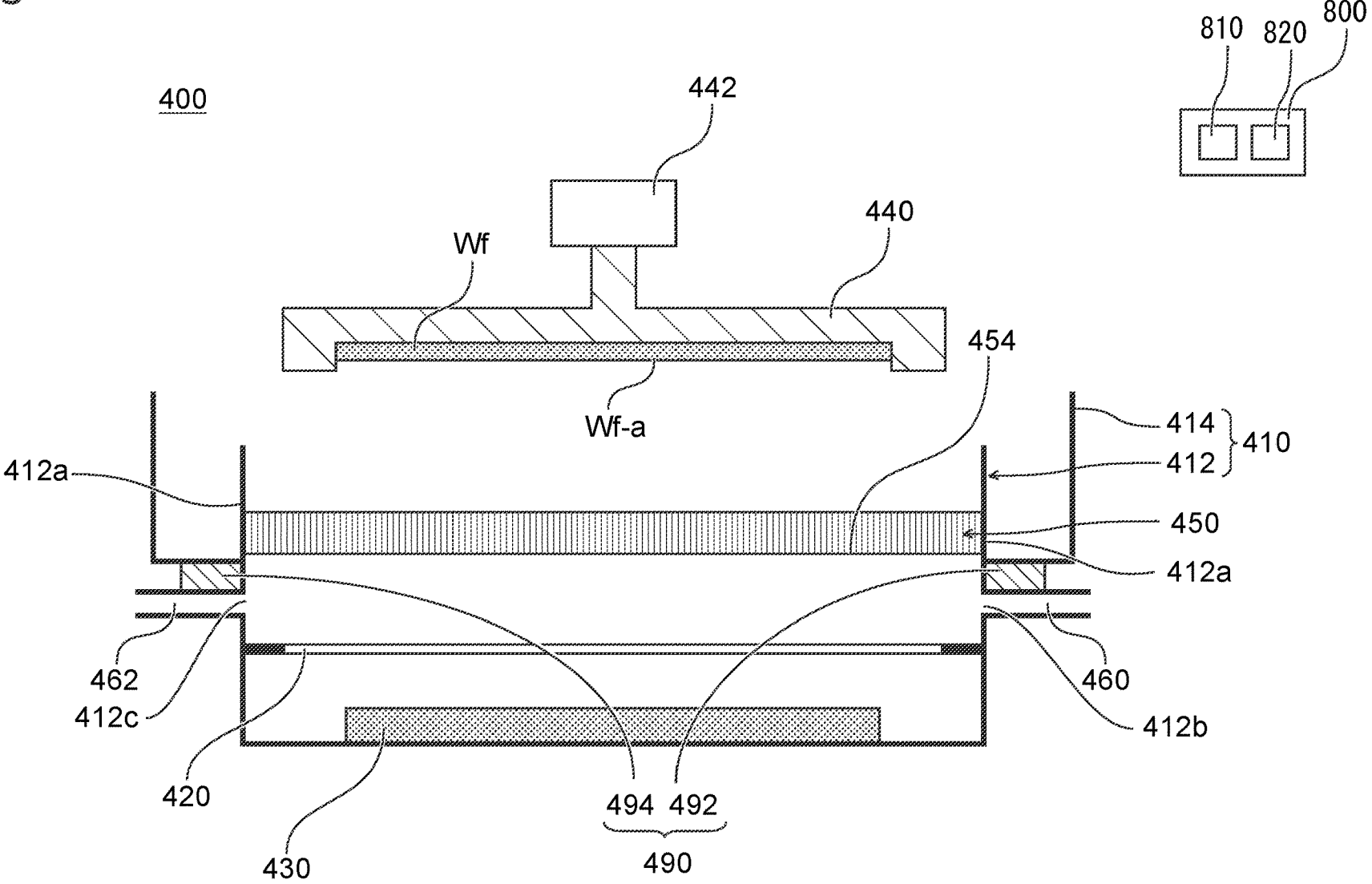
FIG. 8 is a vertical cross-sectional view schematically illustrating a configuration of a plating module of a fourth embodiment.

FIG. 8 is a vertical cross-sectional view schematically illustrating a configuration of a plating module of a fourth embodiment. Since the plating module of the fourth embodiment has a configuration similar to that of the first embodiment except for including an ionically resistive element air bubble detection sensor 490, the description of the configuration overlapping with the first embodiment will be omitted.

As illustrated in FIG. 8, the plating module 400 includes the ionically resistive element air bubble detection sensor 490 for detecting the presence of air bubbles on the surface (the back surface 454) facing the anode 430 of the ionically resistive element 450. The ionically resistive element air bubble detection sensor 490 may be configured as an ultrasonic wave sensor including an ultrasonic wave transmitting member 492 configured to transmit an ultrasonic wave along the surface (the back surface 454) facing the anode 430 of the ionically resistive element 450 and an ultrasonic wave receiving member 494 configured to receive the ultrasonic wave transmitted from the ultrasonic wave transmitting member 492.

According to this embodiment, the ionically resistive element air bubble detection sensor 490 can confirm whether air bubbles are present in the back surface 454 of the ionically resistive element 450. Accordingly, for example, by circulating the plating solution when the liquid is poured into the inner tank 412, the air bubbles in the plating solution can be removed, and after the inner tank 412 is filled with the plating solution, the absence of the remaining air bubbles on the back surface 454 of the ionically resistive element 450 can be confirmed. When the ionically resistive element air bubble detection sensor 490 detects the air bubbles on the back surface 454 of the ionically resistive element 450, the plating module 400 can issue an alarm to circulate the plating solution again. When the ionically resistive element air bubble detection sensor 490 does not detect air bubbles on the back surface 454 of the ionically resistive element 450, the plating module 400 can perform the plating process.

Figure 9:
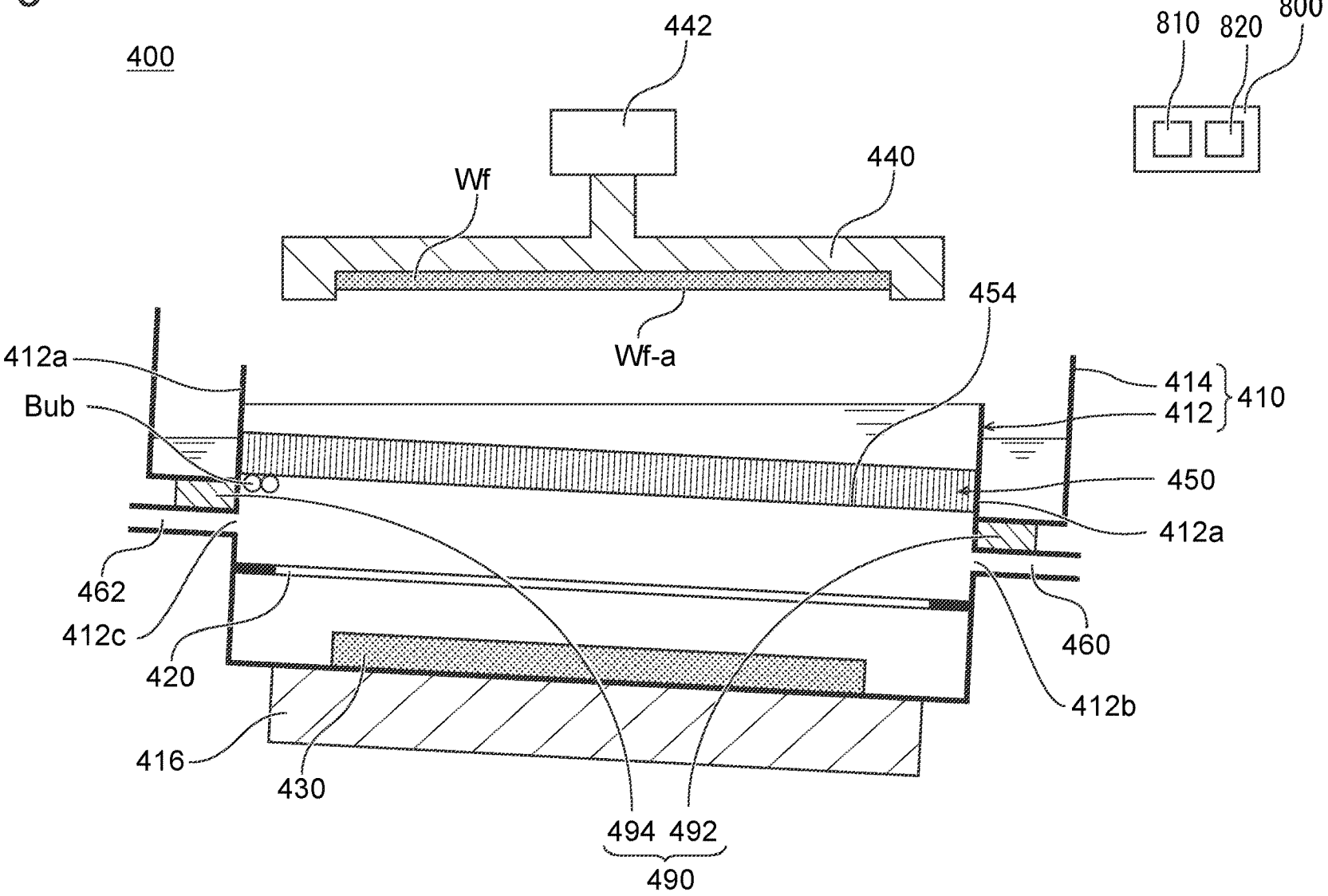
FIG. 9 is a vertical cross-sectional view schematically illustrating a configuration of a plating module of a fifth embodiment.

FIG. 9 is a vertical cross-sectional view schematically illustrating a configuration of a plating module of a fifth embodiment. Since the plating module of the fifth embodiment has a configuration similar to that of the fourth embodiment except for including an inclination mechanism 416, the description of the configuration overlapping with the fourth embodiment will be omitted.

As illustrated in FIG. 9, the plating module 400 includes the inclination mechanism 416 configured to incline the plating tank 410. The inclination mechanism 416 can be achieved by, for example, the known mechanism, such as a tilt mechanism. With the plating tank 410 inclined as illustrated in FIG. 9, the plating module 400 can confirm whether air bubbles are present in the back surface 454 of the ionically resistive element 450 by the ionically resistive element air bubble detection sensor 490.

That is, the ionically resistive element 450 is formed in a disk-shape so as to fit the inner tank 412 having the cylindrical shape. Accordingly, in a case where an air bubble not removed by the circulation of the plating solution is present, the air bubble remains on any position on the circular back surface 454 of the ionically resistive element 450. In a case where the air bubble remains on a position other than a propagation path of the ultrasonic wave transmitted from the ultrasonic wave transmitting member 492 and received by the ultrasonic wave receiving member 494, the air bubble is possibly not detected by the ionically resistive element air bubble detection sensor 490.

In contrast to this, in this embodiment, the inclination of the plating tank 410 also inclines the ionically resistive element 450. Thus, when the air bubbles remain on the back surface 454 of the ionically resistive element 450, as illustrated in FIG. 9, the air bubbles move to the vicinity of the upper end of the ionically resistive element 450. Then, the ultrasonic wave receiving member 494 is disposed near the upper end of the ionically resistive element 450 inclined in association with the inclination of the plating tank 410. Accordingly, in the case where the air bubbles remain on the back surface 454 of the ionically resistive element 450, the plating module 400 of this embodiment moves the air bubbles to the propagation path of the ultrasonic wave by the ionically resistive element air bubble detection sensor 490 to ensure reliably detecting the presence of air bubbles remaining on the back surface 454.

Note that in a case where the ionically resistive element air bubble detection sensor 490 does not detect the air bubbles on the back surface 454 of the ionically resistive element 450, the plating module 400 can perform the plating process after the plating tank 410 is returned to be horizontal by the inclination mechanism 416. Alternatively, the plating module 400 can incline the substrate holder 440 such that the substrate Wf becomes parallel to the anode 430 and perform the plating process.

Figure 10:
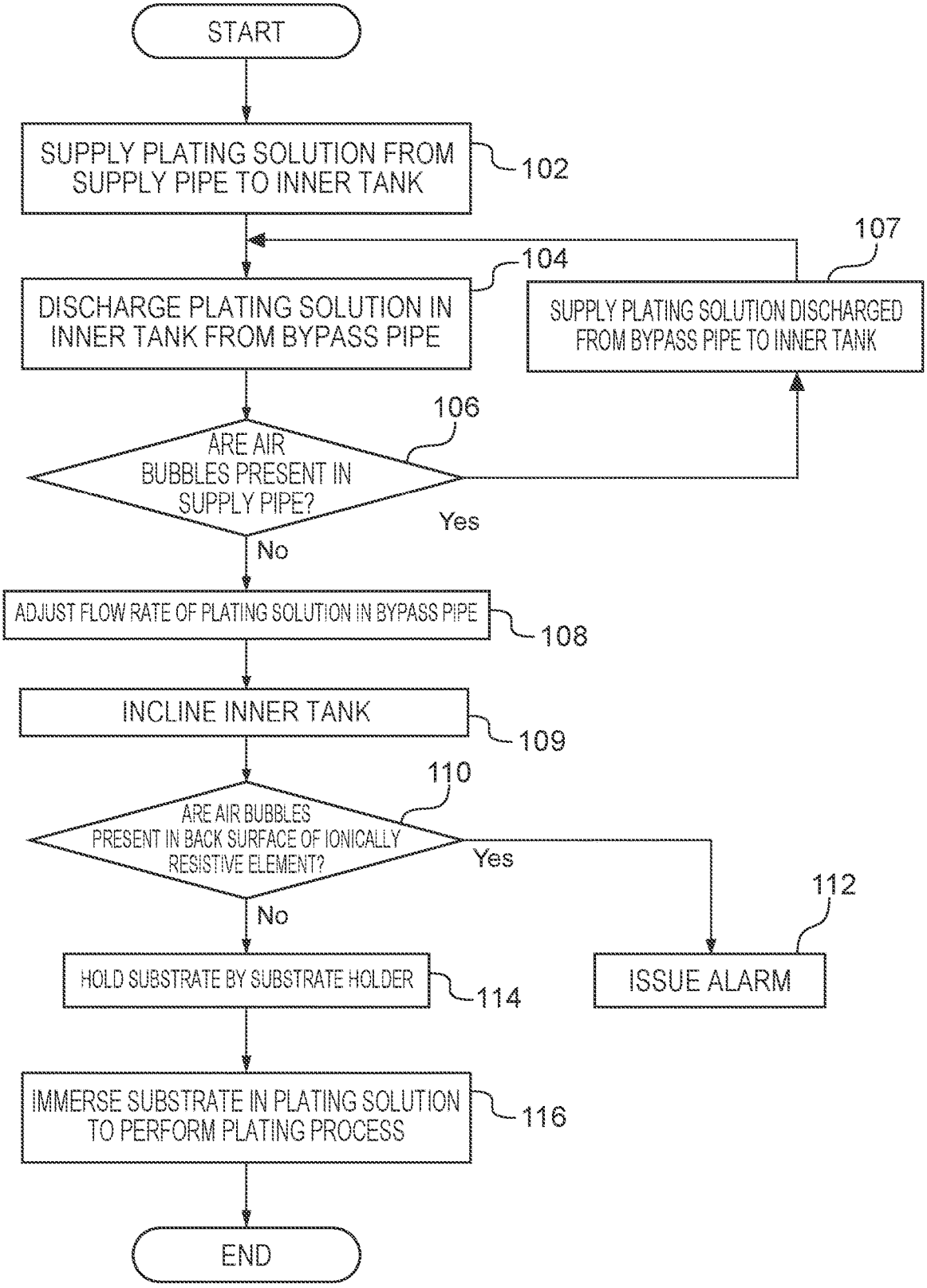
FIG. 10 is a flowchart for an air bubble removing method using the plating module.

Next, the air bubble removing method of this embodiment will be described. FIG. 10 is a flowchart for the air bubble removing method using the plating module. The air bubble removing method of this embodiment is performed when the liquid is poured into the plating module 400. As illustrated in FIG. 10, the air bubble removing method supplies the plating solution stored in the reservoir tank 470 using the pump 472 from the supply pipe 460 to the inner tank 412 (a supplying step 102). Subsequently, the air bubble removing method discharges the plating solution supplied to the inner tank 412 by the supplying step 102 from the bypass pipe 462 to the reservoir tank 470 (a discharging step 104).

Subsequently, the air bubble removing method determines whether the presence of air bubbles is detected in the plating solution flowing through the supply pipe 460 using the pipe air bubble detection sensor 482 (a pipe air bubble detecting step 106). When the presence of air bubbles is detected in the plating solution flowing through the supply pipe 460 (the pipe air bubble detecting step 106, Yes), the air bubble removing method supplies the plating solution stored in the reservoir tank 470 containing the plating solution discharged by the discharging step 104 from the supply pipe 460 to the inner tank 412 (a circulating step 107). The air bubble removing method returns to the discharging step 104 after the circulating step 107 and repeats the discharging step 104, the pipe air bubble detecting step 106, and the circulating step 107.

Note that when the plating module 400 does not include the pipe air bubble detection sensor 482, the pipe air bubble detecting step 106 is not performed. In the case, the air bubble removing method repeats the discharging step 104 and the circulating step 107, for example, for a predetermined period experimentally obtained through experiments or the like and circulates the plating solution, thereby ensuring removing the air bubbles contained in the plating solution. While the supplying step 102 and the circulating step 107 are the same operation in that the plating solution stored in the reservoir tank 470 is supplied to the inner tank 412 with the pump 472, they differ in the point whether the plating solution supplied to the inner tank 412 contains the plating solution discharged from the inner tank 412, and therefore are descried as different steps.

On the other hand, when the presence of air bubbles is not detected in the plating solution flowing through the supply pipe 460 (the pipe air bubble detecting step 106, No), the air bubble removing method adjusts the flow rate of the plating solution flowing through the bypass pipe 462 using the flow rate adjustment mechanism 480 (a flow rate adjusting step 108). For example, when the flow rate adjustment mechanism 480 is an open/close valve, the flow rate adjusting step 108 closes the open/close valve to stop the circulation of the plating solution. Thus, while the plating solution is not discharged from the bypass pipe 462, the plating solution is continuously supplied to the inner tank 412, and therefore the inner tank 412 is filled with the plating solution.

Subsequently, the air bubble removing method inclines the inner tank 412 using the inclination mechanism 416 (an inclining step 109). Note that when the plating module 400 does not include the inclination mechanism 416, the inclining step 109 is not performed. Subsequently, the air bubble removing method determines whether the presence of air bubbles is detected in the back surface 454 of the ionically resistive element 450 using the ionically resistive element air bubble detection sensor 490 (an ionically resistive element air bubble detecting step 110). When the presence of air bubbles is detected on the back surface 454 of the ionically resistive element 450 (the ionically resistive element air bubble detecting step 110, Yes), the air bubble removing method issues an alarm (a step 112).

On the other hand, when the presence of air bubble is not detected in the back surface 454 of the ionically resistive element 450 (the ionically resistive element air bubble detecting step 110, No), the air bubble removing method holds the substrate Wf by the substrate holder 440 (a step 114). Subsequently, the air bubble removing method immerses the substrate Wf in the plating solution to perform the plating process (a step 116).

According to the air bubble removing method of this embodiment, the plating solution is circulated between the inner tank 412 and the reservoir tank 470 to ensure removing the air bubbles contained in the plating solution from, for example, the liquid surface of plating solution inside the inner tank 412 or the liquid surface of the plating solution inside the reservoir tank 470. Accordingly, according to the air bubble removing method of this embodiment, the air bubbles remaining on the back surface 454 of the ionically resistive element 450 when the liquid is poured into the plating tank 410 (the inner tank 412) can be reduced.

As illustrated in FIG. 3 and the like, the control module 800 includes the processing device 810 (for example, a CPU) and the storage medium 820. In addition to various pieces of data used in the plating apparatus 1000, the storage medium 820 stores programs to cause the computer (the control module 800) in the plating apparatus 1000 to execute the respective steps in the above-described air bubble removing method. The processing device 810 (for example, the CPU) in the control module 800 can read and execute the program stored in the storage medium 820. This program can be recorded to a computer-readable storage medium and provided to the control module 800 via the storage medium. Alternatively, this program may be provided to the control module 800 via a communication network, such as the Internet.

In the foregoing, several embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements described in the claims and the specification in a range in which at least a part of the above-described problems can be solved, or a range in which at least a part of the effects can be exhibited.

As one embodiment, this application discloses a plating apparatus that includes a plating tank, a substrate holder, an elevating mechanism, an anode, an ionically resistive element, a supply pipe, and a bypass pipe. The substrate holder is for holding a substrate with a surface to be plated facing downward. The elevating mechanism is for moving up and down the substrate holder. The anode is disposed inside the plating tank so as to face the substrate held by the substrate holder. The ionically resistive element is disposed between the anode and the substrate. The supply pipe is for supplying a process liquid stored in a reservoir tank from a lower side of the ionically resistive element to the plating tank. The bypass pipe is for discharging the process liquid supplied to the plating tank via the supply pipe from the lower side of the ionically resistive element to the reservoir tank.

Furthermore, as one embodiment, this application discloses a plating apparatus that further includes a pump for discharging the process liquid stored in the reservoir tank containing the process liquid discharged from the bypass pipe to the plating tank via the supply pipe.

Furthermore, as one embodiment, this application discloses a plating apparatus that further includes a pipe air bubble detection sensor configured to detect a presence of an air bubble in the process liquid flowing through the supply pipe or the bypass pipe.

Furthermore, as one embodiment, this application discloses a plating apparatus in which the pipe air bubble detection sensor is an ultrasonic wave sensor.

Furthermore, as one embodiment, this application discloses a plating apparatus that further includes a flow rate adjustment mechanism configured to adjust a flow rate of the process liquid flowing through the bypass pipe according to a detection result by the pipe air bubble detection sensor.

Furthermore, as one embodiment, this application discloses a plating apparatus that further includes an ionically resistive element air bubble detection sensor for detecting a presence of an air bubble in a surface facing the anode of the ionically resistive element.

Furthermore, as one embodiment, this application discloses a plating apparatus in which the ionically resistive element air bubble detection sensor is an ultrasonic wave sensor including an ultrasonic wave transmitting member and an ultrasonic wave receiving member. The ultrasonic wave transmitting member is configured to transmit an ultrasonic wave along the surface facing the anode of the ionically resistive element. The ultrasonic wave receiving member is configured to receive the ultrasonic wave transmitted from the ultrasonic wave transmitting member.

Furthermore, as one embodiment, this application discloses a plating apparatus that further includes an inclination mechanism configured to incline the plating tank. The ultrasonic wave receiving member is disposed near an upper end of the ionically resistive element inclined in association with the inclination of the plating tank by the inclination mechanism.

Furthermore, as one embodiment, this application discloses a plating apparatus that further includes a degassing module configured to degas the process liquid flowing through the supply pipe or the bypass pipe.

Furthermore, as one embodiment, this application discloses a plating apparatus that further includes a membrane configured to separate a region where the anode is disposed from a region where the ionically resistive element is disposed. The supply pipe and the bypass pipe are connected between the membrane and the ionically resistive element of the plating tank.

Furthermore, as one embodiment, this application discloses a plating apparatus in which the ionically resistive element includes a porous plate-shaped member or a plate-shaped member. The porous plate-shaped member is disposed to partition between the anode and the substrate. The plate-shaped member has a plurality of through-holes that communicate between the anode side and the substrate side.

Furthermore, as one embodiment, this application discloses a plating apparatus in which the process liquid is a plating solution or a cleaning liquid for cleaning the plating tank.

As one embodiment, this application discloses an air bubble removing method when a process liquid is stored in a plating tank of a cup type plating apparatus. The air bubble removing method includes: a supplying step of supplying the process liquid stored in a reservoir tank from a lower side of an ionically resistive element to the plating tank via a supply pipe, the ionically resistive element being disposed between an anode housed in the plating tank and a substrate; a discharging step of discharging the process liquid supplied to the plating tank by the supplying step from the lower side of the ionically resistive element to the reservoir tank via a bypass pipe; and a circulating step of supplying the process liquid stored in the reservoir tank containing the process liquid discharged by the discharging step from the supply pipe to the plating tank.

Furthermore, as one embodiment, this application discloses an air bubble removing method that further includes a pipe air bubble detecting step of detecting a presence of an air bubble in the process liquid flowing through the supply pipe or the bypass pipe.

Furthermore, as one embodiment, this application discloses an air bubble removing method that further includes a flow rate adjusting step of adjusting a flow rate of the process liquid flowing through the bypass pipe according to a detection result in the pipe air bubble detecting step.

Furthermore, as one embodiment, this application discloses an air bubble removing method that further includes an ionically resistive element air bubble detecting step of detecting a presence of an air bubble in a surface facing the anode of the ionically resistive element.

Furthermore, as one embodiment, this application discloses an air bubble removing method that further includes an inclining step of inclining the plating tank before performing the ionically resistive element air bubble detecting step.

Furthermore, as one embodiment, this application discloses a storage medium that stores a program for causing a computer in a plating apparatus to execute an air bubble removing method when a process liquid is stored in a plating tank. The air bubble removing method includes: a supplying step of supplying the process liquid stored in a reservoir tank from a lower side of an ionically resistive element to the plating tank via a supply pipe, the ionically resistive element being disposed between an anode housed in the plating tank of a cup type plating apparatus and a substrate; a discharging step of discharging the process liquid supplied to the plating tank by the supplying step from the lower side of the ionically resistive element to the reservoir tank via a bypass pipe; and a circulating step of supplying the process liquid stored in the reservoir tank containing the process liquid discharged by the discharging step from the supply pipe to the plating tank.

REFERENCE SIGNS LIST

410 . . . plating tank
412 . . . inner tank
412*a* . . . sidewall
412*b* . . . supply port
412*c* . . . discharge port
414 . . . outer tank
416 . . . inclination mechanism
420 . . . membrane
422 . . . cathode region
424 . . . anode region
430 . . . anode
440 . . . substrate holder
442 . . . elevating mechanism
450 . . . ionically resistive element
452 . . . through-hole
454 . . . back surface
460 . . . supply pipe
462 . . . bypass pipe
470 . . . reservoir tank
472 . . . pump
480 . . . flow rate adjustment mechanism
482 . . . pipe air bubble detection sensor
484 . . . degassing module
490 . . . ionically resistive element air bubble detection sensor
492 . . . ultrasonic wave transmitting member
494 . . . ultrasonic wave receiving member
800 . . . control module
810 . . . processing device
820 . . . storage medium
1000 . . . plating apparatus
Bub . . . air bubble
Wf . . . substrate
Wf-a . . . surface to be plated

What is claimed is:

1. A plating apparatus comprising: a plating tank;

a substrate holder for holding a substrate with a surface to be plated facing downward;

an elevating mechanism for moving the substrate holder up and down;

an anode disposed inside the plating tank so as to face the substrate held by the substrate holder;

an ionically resistive element disposed between the anode and the substrate;

a membrane configured to separate a region where the anode is disposed from a region where the ionically resistive element is disposed;

a supply pipe for supplying a process liquid stored in a reservoir tank from a lower side of the ionically resistive element to the plating tank;

and a bypass pipe for discharging the process liquid supplied to the plating tank via the supply pipe from the lower side of the ionically resistive element to the reservoir tank, wherein the supply pipe and the bypass pipe are connected between the membrane and the ionically resistive element of the plating tank, the plating apparatus further comprising a control module configured to: supply the process liquid stored in the reservoir tank from the lower side of the ionically resistive element to the plating tank via the supply pipe;

discharge the process liquid supplied to the plating tank from the lower side of the ionically resistive element to the reservoir tank via the bypass pipe;

circulate the process liquid between the reservoir tank and the plating tank by supplying the process liquid from the reservoir tank to the plating tank and discharging the process liquid from the plating tank to the reservoir tank for a predetermined period under a condition that a liquid surface of the process liquid in the plating tank does not go higher than a back surface of the ionically resistive element; and stop the circulation of the process liquid after the predetermined period has passed and fill the plating tank with the process liquid up to an upper side of the ionically resistive element.

2. The plating apparatus according to claim 1, further comprising a pump for discharging the process liquid stored in the reservoir tank containing the process liquid discharged from the bypass pipe to the plating tank via the supply pipe.

3. The plating apparatus according to claim 1, further comprising a flow rate adjustment mechanism configured to adjust a flow rate of the process liquid flowing through the bypass pipe, wherein the flow rate adjustment mechanism is configured to stop circulation of the process liquid after the process liquid circulates via the bypass pipe, the reservoir tank, and the supply pipe for a predetermined period.

4. The plating apparatus according to claim 1, further comprising a pipe air bubble detection sensor configured to detect a presence of an air bubble in the process liquid flowing through the supply pipe or the bypass pipe.

5. The plating apparatus according to claim 4, wherein the pipe air bubble detection sensor is an ultrasonic wave sensor.

6. The plating apparatus according to claim 4, further comprising a flow rate adjustment mechanism configured to adjust a flow rate of the process liquid flowing through the bypass pipe according to a detection result by the pipe air bubble detection sensor.

7. The plating apparatus according to claim 1, further comprising an ionically resistive element air bubble detection sensor for detecting a presence of an air bubble in a surface facing the anode of the ionically resistive element.

8. The plating apparatus according to claim 7, wherein the ionically resistive element air bubble detection sensor is an ultrasonic wave sensor including an ultrasonic wave transmitting member and an ultrasonic wave receiving member, the ultrasonic wave transmitting member is configured to transmit an ultrasonic wave along the surface facing the anode of the ionically resistive element, and the ultrasonic wave receiving member is configured to receive the ultrasonic wave transmitted from the ultrasonic wave transmitting member.

9. The plating apparatus according to claim 8, comprising an inclination mechanism configured to incline the plating tank, wherein the ultrasonic wave receiving member is disposed near an upper end of the ionically resistive element inclined in association with the inclination of the plating tank by the inclination mechanism.

10. The plating apparatus according to claim 1, further comprising a degassing module configured to degas the process liquid flowing through the supply pipe or the bypass pipe.

11. The plating apparatus according to claim 1, wherein the ionically resistive element includes a porous plate-shaped member or a plate-shaped member, the porous plate-shaped member is disposed to partition between the anode and the substrate, and the plate-shaped member has a plurality of through-holes that communicate between the lower side and the upper side.

12. The plating apparatus according to claim 1, wherein the process liquid is a plating solution or a cleaning liquid for cleaning the plating tank.

* * * * *